United States Patent [19]

MacDonald

[11] Patent Number: 5,014,477

[45] Date of Patent: May 14, 1991

[54] BUILDING FACADE

[76] Inventor: Michael W. MacDonald, 69 June Ave., Northport, N.Y. 11768

[21] Appl. No.: 529,594

[22] Filed: May 29, 1990

[51] Int. Cl.[5] ..... E04H 1/00

[52] U.S. Cl. ..... 52/235; 52/398

[58] Field of Search ..... 52/235, 409, 258, 511, 52/780, 781

[56] References Cited

U.S. PATENT DOCUMENTS

| | | | |
|---|---|---|---|
| 2,885,040 | 5/1959 | Grossman | 52/235 |
| 4,448,001 | 5/1984 | Whitmyer et al. | 52/235 X |
| 4,543,755 | 10/1985 | Crandell | 52/235 |
| 4,608,793 | 9/1986 | Yost et al. | 52/235 |
| 4,650,702 | 3/1987 | Whitmyer | 52/235 X |
| 4,809,475 | 3/1989 | Emmer | 52/235 |
| 4,837,996 | 6/1989 | Eckelt | 52/235 |

*Primary Examiner*—David A. Scherbel
*Assistant Examiner*—Creighton Smith
*Attorney, Agent, or Firm*—Myron Amer

[57] ABSTRACT

For supporting a facade on a building having in place mullions with forwardly extending facade-supporting members, an extrusion cut to an appropriate length for adhesive attachment along an edge of a facade panel in spaced relation to an additional cooperating extrusion length, such that a mullion facade-supporting member is provided with an operative position projected between the extrusions, and attachment is thus able to be achieved using screws projected in opposite directions through the extrusions and threadably engaged to the centrally located mullion facade-supporting member.

3 Claims, 3 Drawing Sheets

BUILDING FACADE

The present invention relates generally to a building facade, and more particularly to improvements in the mounting of facade panels to form the finished outside wall of a building, said facade panels usually being made of thermally insulated glass plates, but also on occasion being made of metal or simulated masonry.

EXAMPLES OF THE PRIOR ART

It is already well known to use aluminum or other construction material extrusions in attaching a facade to a building, as exemplified by the disclosure and illustration thereof in U.S. Pat. No. 4,809,475 issued to Emmer on Mar. 7, 1989, but this and all other known facade extrusion mountings do not significantly diminish the difficulties in the procedures and complexity in the support constructions required in placing the facade in its operative position in covering relation over a building.

Pertinent to a somewhat lesser extent is the facade mounting described and illustrated in U.S. Pat. No. 4,581,089 issued to MacMillan on Apr. 8, 1986 in which facade panels are attached to a forward extension of a mullion, which is also a mounting technique used in accordance with the present invention, but absent in MacMillan is the use of an extrusion as proposed herein, which greatly simplifies the off-site preparation of the facade panels preparatory to their transportation to the building site for installation.

It is broadly an object of the present invention to overcome the facade-mounting complexities and other shortcomings of the prior art. More particularly, it is an object to support the facade panels on a mullion support member, but to use in an interposed position therebetween, i.e. between the mullion support member and facade panels, an extrusion as a mounting component which results in a readily achieved threaded interengagement therebetween and other noteworthy benefits, all as will be subsequently explained in greater detail.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a vertical section of a prior art building facade;

FIG. 2 is a sectional view taken along line 2—2 of FIG. 1, illustrating, on an enlarged scale, details of the mounting of the facade to the building using, as also is used in accordance with the present invention, an extrusion, but with significant differences therebetween;

FIG. 3 is a scaled down version of FIG. 2, showing the position of the facade relative to the building over which it is used;

FIG. 4 is a sectional view similar to FIG. 2, but of another prior art facade-mounting construction; and FIG. 5 is a view similar to FIG. 3.

Figure 2:
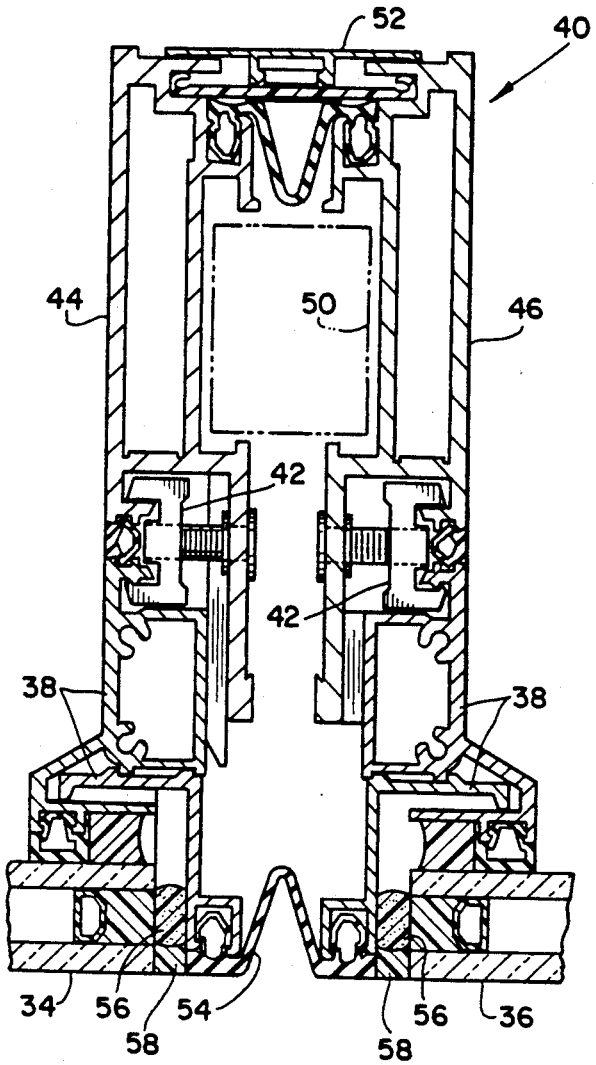
FIG.2 PRIOR ART
Figure 7:
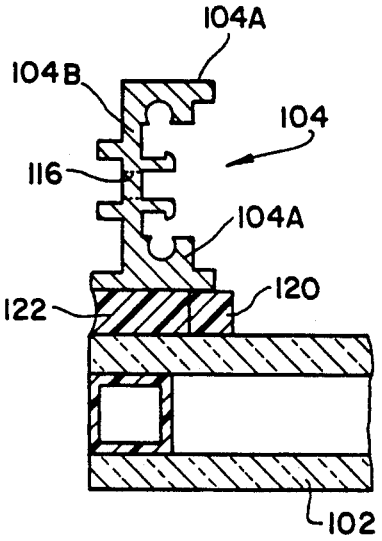
Figure 6:
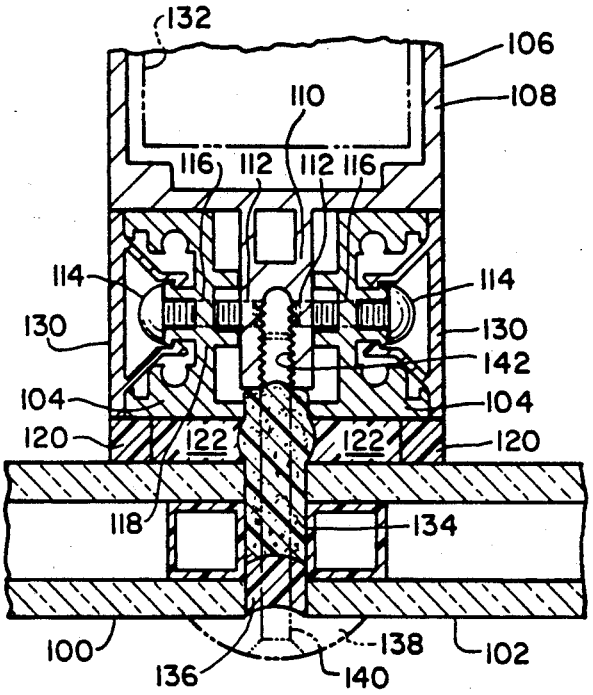
Figure 8:
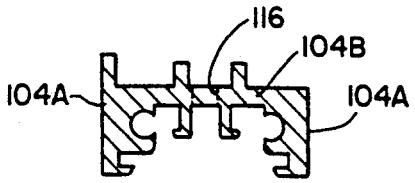
Figure 9:
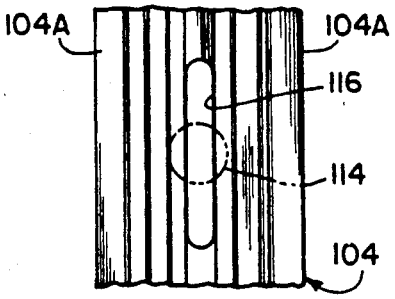

The remaining figures are of the within inventive improvements for a building facade, in which FIG. 6 is a sectional view, provided for comparison purposes with FIG. 2, and also is a sectional view in a horizontal perspective;

FIG. 7 is a view of a partial assembly illustrated in FIG. 6;

FIG. 8 is a sectional plan view of an extrusion component of the within inventive assembled facade unit;

FIG. 9 is an elevational view of the extrusion component of FIG. 8; and

Figure 10:
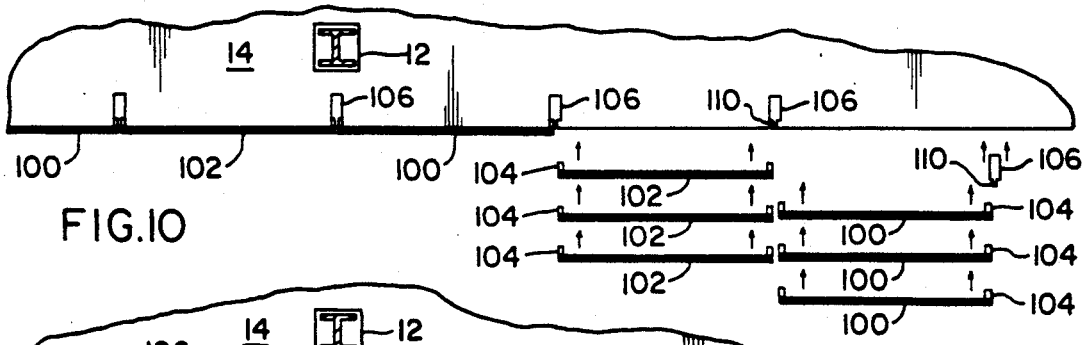
Figure 11:
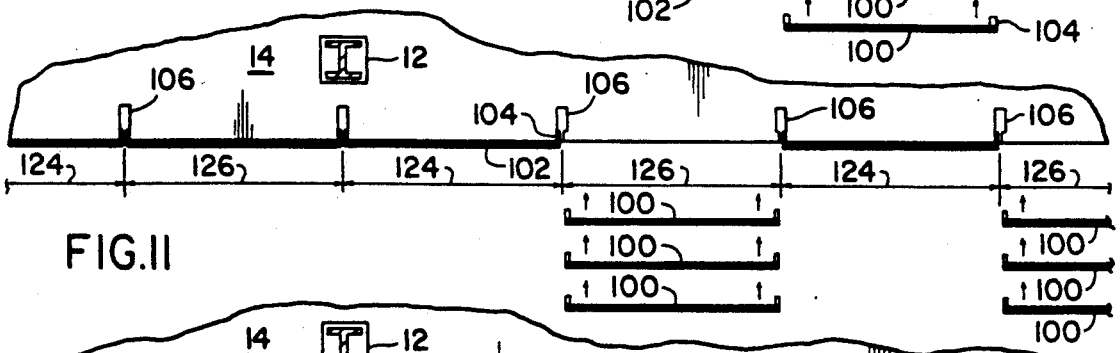
Figure 12:
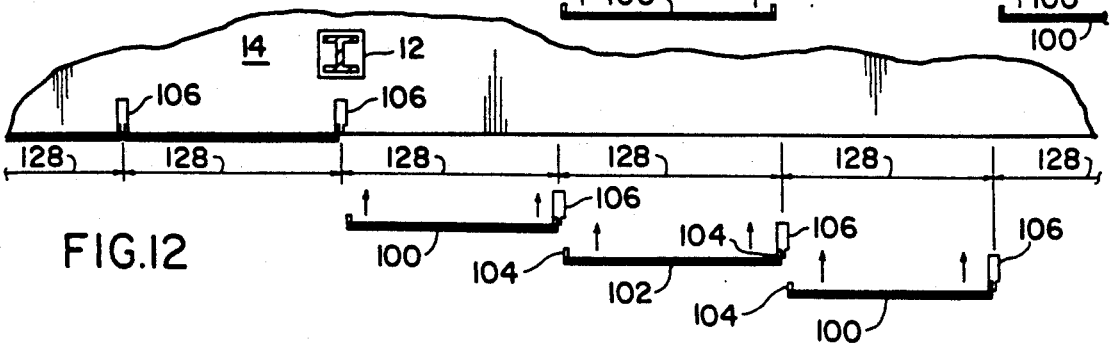

FIGS. 10, 11 and 12 are schematic plan views showing optional methods of attaching assembled facade units to a building.

Figure 1:
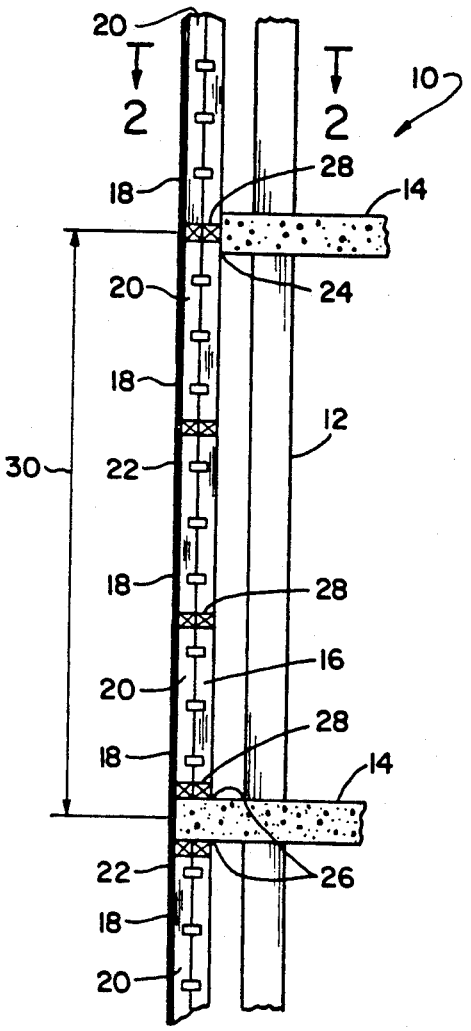
FIG.1 PRIOR ART
FIGS. 1-5 are of the prior art and are provided for comparison purposes, in which more particularly.

It is already well known to use aluminum or other construction material extrusions in attaching a facade to a building, as exemplified by the disclosure and illustration thereof in U.S. Pat. No. 4,809,475 issued to Emmer on Mar. 7, 1989, but this and all other known facade extrusion mountings do not significantly diminish the difficulties in the procedures and complexity in the support constructions required in placing the facade in its operative position in covering relation over a building. As background, and to better understand by comparison the within inventive facade mounting subsequently to be described in detail, reference should be made to the Emmer facade system schematically illustrated in FIG. 1 in which there is shown a building 10 of a known type comprised of vertical columns 12 which support reinforced concrete or steel truss-supported concrete floors 14. A primary framework 16 is used to support facade panels 18 that are each fitted with a secondary framing 20. Alternately the facade panels 18 are sometimes connected directly to framework 16. Facade panels 18 form the finished outside wall of building 10 and are usually made of thermally insulated glass plates 22 but can be made of metal or simulated masonry. Vertical primary framing 16 can be conventionally attached to the edge of each floor 14, as at 24, or mounted between floors, as at 26. Horizontal framing 28 is placed in selected locations as structurally required. Individual facade panels 18, with or without secondary framing 20 in place, may be installed on primary framing 16 already in place on the site of building 10, or multiple panels 18 may be factory-assembled to primary frame 16 as an assembled unit 30, which unit 30 is then transported to and installed on building 10. Connections between panels 18, secondary frames 20 and primary frame 16 are caulked weather tight, and joints 32 between adjacent panels 18 are additionally silicone sealed weather tight.

Figure 3:
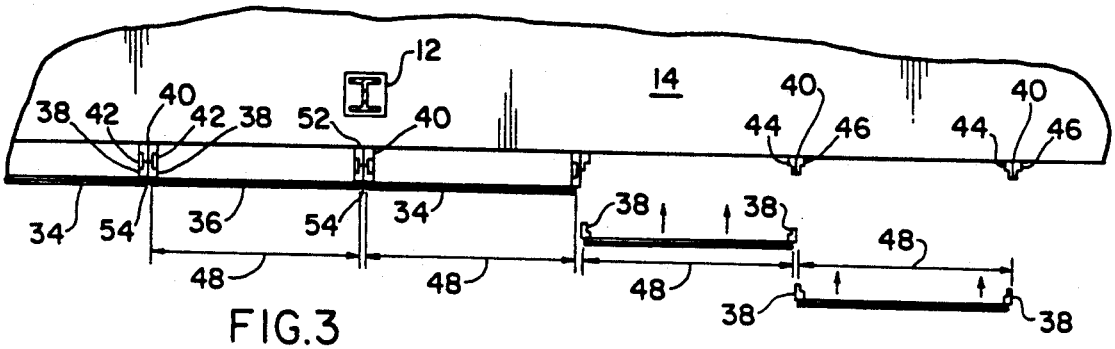
FIG.3 PRIOR ART

FIGS. 2 and 3 illustrate typical structural details of the prior art facade system, in this illustrative example being that of the previously noted Emmer patent wherein adjacent panels 34 and 36 have a metal two piece factory-assembled auxiliary frame 38, each connected to a main frame assembly 40 by a coupling arrangement 42. Main frame 40 is made in two separate pieces, designated 44 on the of left FIG. 2 and designated 46 on the right. In this prior system a multipanel assembly 48 (FIG. 3) may be factory assembled on frame 44 and on a frame 46 along with appropriate horizontal framing members, for a site connection to a like multipanel assembly 48. When frame 46 is assembled to adjacent frame 44 to form primary frame 40, the use of a reinforcing member 50 known in the trade as a mullion, shown in phantom perspective, is required to complete the supported attachment of the facade to the building. An interconnecting cover 52 assists in joining the frames 44 and 46.

Panel section 34 and 36 are then individually joined to main frame 40 by respectively connecting auxiliary frames 38 with the use of coupling means 42 which are produced as aluminum or other construction material extrusions. In this procedure seal means 54 is made secure to adjacent panels 34 and 36 by caulking 56, and made weather tight by silicone seals 58. Components 44, 46, 38 and 42 are enclosed in an air tight insulation by appropriate seal members and caulking, such as is exemplified by that shown in FIG. 2, at 54, 56 and 58.

Figure 4:
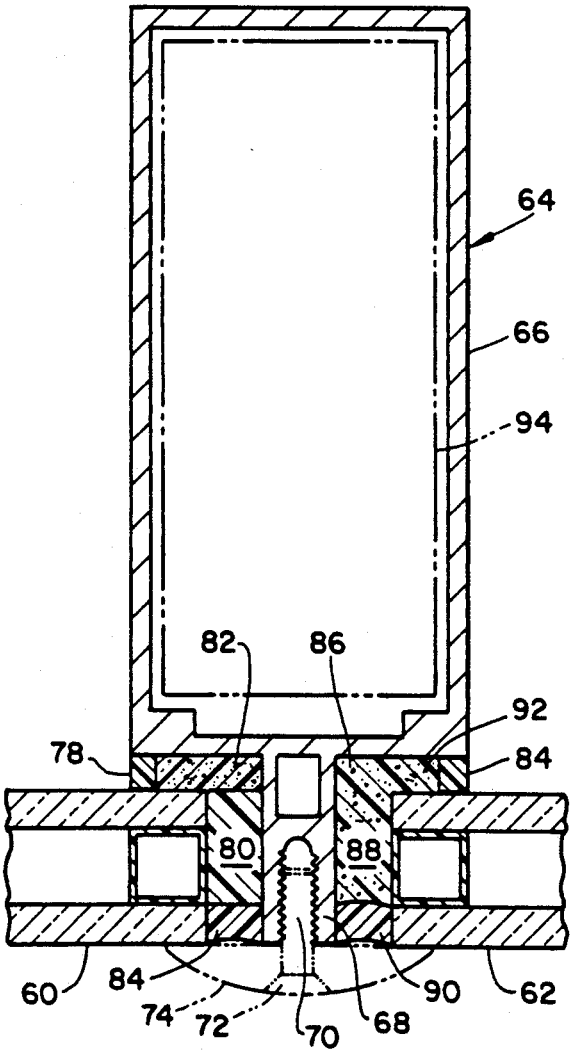
FIG.4 PRIOR ART

A somewhat simplified prior art system of panel framing is shown in FIG. 4, wherein adjacent facade panels 60 and 62 are mounted directly to primary framing 64 without any intermediate framing. Framing 64 is basically a hollow rectangular mullion with a forwardly extending projection 68 on one of its narrower sides. Projection 68 is provided with a serrated longitudinal groove 70 used to receive screws 72 for attaching trim 74 at an on site installation. When trim 74 is not used, groove 70 is filled with caulking or closed with a snap-in trim piece (not shown).

Figure 5:
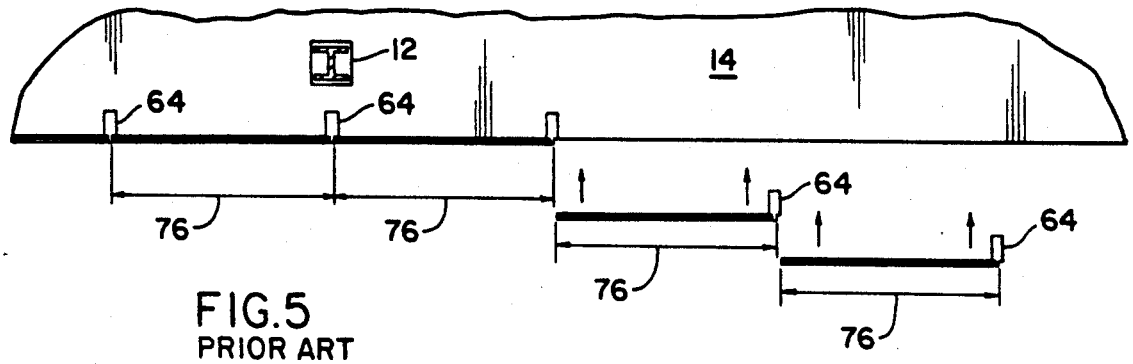
FIG.5 PRIOR ART

As shown schematically in FIG. 5, multipanel assemblies 76 may be put together at a non-construction site and assembled on site to other multipanel assemblies 76. Panels 60 and 62 are adhesively attached to primary framing or supporting mullions 64 along one edge. Seals 78 and 80 provide a suitable seat for the panels and close off a void 82 which is filled with caulking. A silicone weather seal 84 completes the left side assembly, as viewed in FIG. 4, between main frame 64 and the panel.

In the on site facade mounting procedure, the assembly 76 is next moved into position seated against a space block 78' already adhesively adhered to the left edge of panel 62. Empty space or void 86 between tubing or mullion 66 and this panel is then filled with caulking 88 and completed with a silicone weather seal 90. Although occasioned with difficulty, this silicone must be filed in the "hidden" area 92 otherwise there might be subsequent failure of a joint between some facade panels and the mullion support thereof.

In an alternate assembly procedure, facade panels 60 and 62 can, of course be installed individually to the mullions 64 already in place on building 10. If structurally required, an additional reinforcing member 94 may be installed for structural stability within the hollow chamber of the mullion 64.

Referring now to the facade support of the present invention as shown in FIGS. 6–12, facade panels 100 and 102 are each factory assembled with a one piece secondary or intermediate frame 104 which in accordance with the present invention is fabricated as an aluminum extrusion (FIG. 7). Frames or extrusions 104 are adhesively attached to panels 100 and 102 to align with primary framing or mullions 106. Mullions 106, (FIG. 6) also preferrably made of extruded aluminum, each have a cross section similar to that shown in FIG. 4, and will be understood to be the functional equivalent of the primary framing 64 described in the Emmer prior art facade system. Mullion 106 is basically a rectangular tubing 108 that has a forwardly extending projection 110, as does previously described prior art mullion 64. Significantly differing, both as to construction and use however, projection 110, unlike projection 68, is fabricated with an array of tapped holes 112 to receive screws 114 which are used to secure the extrusions 104 to a cooperating mullion projection 110. To facilitate alignment, the extrusions 104 are provided with spaced slots 116, only one of which is shown in the partial length portion illustrated in FIG. 9, so that facade mounting is achieved by the attachment, using screws 114, threadably disposed from opposite directions through the slots 116 of the extrusions 104 and into the tapped holes 112 in the weight supporting projections or support members of the mullions 104. To facilitate factory preparation of the facade panels 100, and 102 for on site attachment over the front of the building, the extrusions 104 provided for this purpose are extruded in the shape shown which, as best shown in FIG. 8, consists of a c-shape defined by opposite legs 104A and a connecting body or walls 104B.

Each panel 100 or 102 is shop assembled using a bonding strip 120 between this panel and a cooperating extrusion 104. Space 122 is then filled with caulking. This basic facade assembled unit provides a variety of shop or on site facade mounting procedures, now to be described, which are not available with prior art facade systems, which even contemplate use of extrusion components.

As seen in FIG. 10, when heavy duty lifting equipment, such as cranes, fork lifts, or the like, are not available, each bay of facade paneling can be placed in supported position on the building as a part of the building construction process. That is, the mullions 106 can be embodied in the building in a well understood manner, and proceeding from left to right, after the embodiment of the spaced mullions 106, the facade panels 100, 102 can then be supportingly attached to the mullion support members 110 using the screws 114, as already previously explained in detail in connection with FIG. 6.

Optionally, and as shown in FIG. 11, multipanel bays 124 comprised of panels 102 can be off-site assembled and transported to the building site, and at the site panels 100 assembled and attached in alternate locations to the mullions support members 110, and the panels 102 then attached to the mullion support members in the alternate spaces left therebetween. Thus, half the facade panels, such as the panels 100 can be assembled at the site, and the other half, namely panels 102, assembled to the extent illustrated and described in connection with, FIG. 7 at the factory and transported to the site for attachment to the building. This division of labor of facade panel units being constructed on site and also off site, contributes to efficiently applying a facade to a building.

In FIG. 12, multipanel bays 128, consisting of attached adjacent panels 100 and 102 are preassembled, either on or off site, and then lifted by crane or appropriate equipment into place. Mullions 106 are attached along the sides of the panels 100 and 102, to embody the facade units 128 with a component functionally capable of achieving attachment in a well understood manner to the building. As understood, the mullions 106 are placed over a vertical beam 132 or the like (FIG. 6).

For completeness sake, it is noted that following the threaded attachment of facade panel units 100, 102 to the mullions 106, and more particularly to the support members 110 thereof, that caps 130 are snapped in place in covering relation over the screws, (FIG. 6) to provide a finished appearance to the described facade-mounting construction. In addition, the serrated longitudinal groove 142 is used to receive screw 140 for attaching trim 138 as known. Additionally, the space between the panels may be filled by caulking 134 covered by sealant 136.

While the particular facade-mounting components and method of using same herein shown and disclosed in detail are fully capable of attaining the objects and provided the advantages hereinbefore stated, it is to be understood that they are merely illustrative of the presently preferred embodiment of the invention and that no limitations are intended to the detail of construction or design herein shown other than as defined in the appended claims.

What is claimed is:

1. Improvements for a facade for a building front surface of the type constructed on site with plural mullions, each said mullion being of the type having an outwardly directed planar face having a single, centrally located forwardly projecting mullion support member for attachment thereto of a facade for said building, the improvements comprising an assembled facade unit consisting of a pair of identical spaced apart extrusions positioned forwardly of said one mullion with said mullion support member in an interposed position therebetween, each said extrusion being a c-shape defined by opposite legs and a connecting wall therebetween and having an operative position with each of said c-shapes in an outwardly facing relation to each other so as to locate one of said legs of each of said c-shapes against said planar face of said mullion, said connecting wall against said mullion support member, and said opposite leg in a spaced position from said mullion, a pair of facade panels in a side-by-side relation each of said panels adhesively attached to one each of said outer legs of said extrusions, plural cooperating screws connected in opposing directions and directed inwardly through said extrusions and into said mullion support member, whereby said facade unit is supported in covering relation over said building front by the screwed attachment thereof to said mullion support member.

2. The extrusion for a building facade as claimed in claim 1, wherein the connecting wall has an elongated slot to facilitate the alignment of a screw projected therethrough preparatory to establishing engagement to said mullion support member.

3. The use with the extrusion for a building facade as claimed in claim 2 of a cap having an operative position in engaged relation onto a head of a cooperating screw, to provide an enhanced appearance to said extrusion using said screw.

* * * * *